United States Patent [19]

Mongia et al.

[11] Patent Number: 4,545,196

[45] Date of Patent: Oct. 8, 1985

[54] VARIABLE GEOMETRY COMBUSTOR APPARATUS

[75] Inventors: Hukam C. Mongia; Edwin B. Coleman, both of Tempe; Thomas W. Bruce, Phoenix, all of Ariz.

[73] Assignee: The Garrett Corporation, Los Angeles, Calif.

[21] Appl. No.: 400,579

[22] Filed: Jul. 22, 1982

[51] Int. Cl.[4] ..... F02C 3/14

[52] U.S. Cl. ..... 60/39.23; 60/733; 60/742

[58] Field of Search ..... 60/39.02, 39.23, 39.36, 60/39.38, 39.826, 740, 746, 748, 752, 732, 733, 742

[56] References Cited

U.S. PATENT DOCUMENTS

| | | | |
|---|---|---|---|
| 2,227,666 | 1/1941 | Noack | 60/39.23 |
| 2,856,755 | 10/1958 | Szydlowski | 60/39.36 |
| 2,999,359 | 9/1961 | Murray . | |
| 3,026,675 | 3/1962 | Vesper et al. . | |
| 3,124,933 | 3/1964 | Stram et al. | 60/39.826 |
| 3,961,475 | 6/1976 | Wood . | |
| 4,192,139 | 3/1980 | Buchheim | 60/39.826 |
| 4,420,929 | 12/1983 | Jorgensen et al. | 60/733 |

FOREIGN PATENT DOCUMENTS

| | | | |
|---|---|---|---|
| 791617 | 3/1958 | United Kingdom . | |
| 894054 | 4/1962 | United Kingdom | 60/748 |
| 2040031 | 8/1980 | United Kingdom | 60/733 |

OTHER PUBLICATIONS

Carlstrom et al., *Improved Emissions Performance in Today's Combustion System,* paper presented at AEG/-SOA Seminar; Athens, Greece; Jun. 1978.

*Primary Examiner*—Louis J. Casaregola

*Attorney, Agent, or Firm*—J. Richard Konneker; Albert J. Miller

[57] ABSTRACT

The fuel nozzles in a variable geometry combustor cooperate with an inwardly projecting liner wall section to define a sheltered pilot combustion zone within the liner. Simultaneously operable inlet valves are provided for admitting a selectively variable quantity of combustion air into the pilot zone.

5 Claims, 5 Drawing Figures

VARIABLE GEOMETRY COMBUSTOR APPARATUS

The Government has rights in this invention pursuant to Contract No. F33615-79-C-2000 awarded by the U.S. Air Force.

BACKGROUND OF THE INVENTION

The present invention relates generally to combustors utilized in gas turbine propulsion engines. More particularly, this invention provides variable geometry combustor apparatus, and associated methods, for imparting significantly improved stability and ignition performance to high-temperature rise combustion systems employed in advanced gas turbine aircraft propulsion engines.

Continuing evolution and improvements in combustor design have resulted in highly efficient fixed geometry combustors for conventional aircraft gas turbine propulsion engines. However, it is well known that such conventional combustors have significant limitations and disadvantages when utilized in the propulsion engines of ultra-high performance aircraft operating within expanded altitude-mach number flight envelopes. Among the more critical of these recognized combustor deficiencies arising from flight envelope expansion are combustion instability, high altitude relight difficulties and ground ignition problems at low ambient temperatures.

Accordingly, it is an object of the present invention to provide improved combustor apparatus, and associated methods, which eliminate or minimize above-mentioned and other limitations and disadvantages associated with conventional fixed geometry combustors.

SUMMARY OF THE INVENTION

In carrying out principles of the present invention, in accordance with a preferred embodiment thereof, a gas turbine propulsion engine is provided with a specially designed variable geometry combustor which is operable to significantly expand the altitude-mach number flight envelope within which the engine may be operated without experiencing the combustor lean instability and relight problems associated with conventional fixed geometry combustors.

The variable geometry combustor constituting the preferred embodiment is of an annular, reverse flow configuration, having a hollow, annular combustor liner which is surrounded by an intake plenum that receives high pressure discharge air from the engine's compressor section. The combustor liner has an annular upstream end wall through which a circumferentially spaced series of air inlet openings are formed.

Connected to the end wall at each of these inlet openings is one of a circumferentially spaced series of valve means for selectively admitting compressor discharge air into the combustion liner interior from the combustor plenum through the end wall openings. The valve means may be simultaneously opened or closed by actuation means positioned within the combustor inlet plenum and operable from the exterior of the combustor. Air entering the combustor liner interior through the spaced array of valve means has imparted thereto a swirl pattern having axial and tangential components by air swirler means positioned in each of the end wall inlet openings.

Positioned downstream from the liner end wall, and projecting generally radially into the liner interior (which serves as a combustion flow passage), are a circumferentially spaced series of fuel nozzle means. These fuel nozzle means, together with an inwardly projecting annular liner wall portion positioned generally radially opposite the nozzle array, define and partially separate axially adjacent, communicating annular pilot and main combustion zones within the liner interior, the primary zone being directly adjacent the liner end wall. Each of the nozzle means has two separately operable fuel spray outlets which respectively deliver atomized fuel in opposite axial directions into the pilot and main combustions zones. To provide a generally uniform exhaust temperature profile, dilution air from the combustor plenum is admitted to the combustion flow passage through annular arrays of inlet openings formed in the liner walls adjacent the upstream end of the main combustion zone.

During operation of the combustor, the opposed nozzle array and inwardly projecting liner wall portion uniquely cooperate to "shelter" the pilot combustion zone from adverse interaction with the main combustion zone. More specifically, even when combustion in the main zone is abruptly terminated (by, for example, a sudden throttling back of the engine which interrupts fuel flow through the main zone outlets of the nozzles), combustion in the pilot zone is substantially unaffected. The novel cooperative use of the nozzles and inwardly projecting liner wall portion thus greatly enhances the ignition stability of the combustor in all portions of the expanded flight envelope in which it may be operated.

Moreover, the ability, afforded by the simultaneously operable inlet valve means, to selectively terminate the swirler air inflow to the pilot combustion zone allows the selective maximization of the fuel richness of the fuel-air mixture therein. This feature of the invention substantially improves the high altitude relight, lean stability, and ground start capabilities of the combustor compared to conventional fixed geometry combustor apparatus.

DETAILED DESCRIPTION

Figure 1:
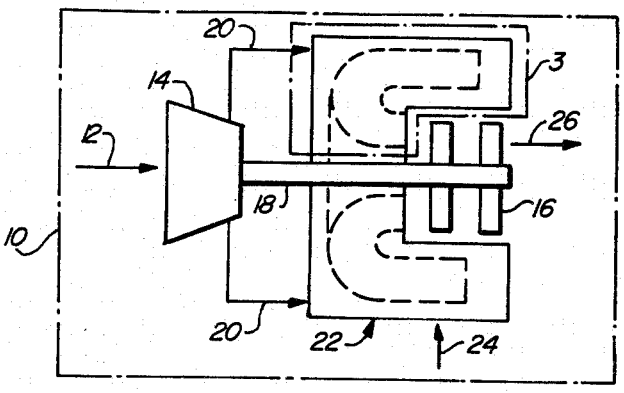
FIG. 1 is a greatly simplified schematic diagram of a gas turbine propulsion engine having a variable geometry combustor embodying principles of the present invention.

Schematically illustrated in FIG. 1 are the primary components of a gas turbine propulsion engine 10 which embodies principles of the present invention. During operation of the engine, ambient air 12 is drawn into a compressor 14 which is spaced apart from and rotationally coupled to a bladed turbine section 16 by an interconnecting shaft 18. Pressurized air 20 discharged from compressor 14 is forced into an annular, reverse flow combustor 22 which circumscribes the turbine section 16 and an adjacent portion of the shaft 18. The air 20 is mixed within the combustor with fuel 24, the resulting fuel-air mixture being continuously burned and discharged from the combustor across turbine section 16 in the form of hot, expanded gas 26. This expulsion of the gas 26 simultaneously drives the turbine and compressor, and provides the engine's propulsive thrust.

Figure 2:
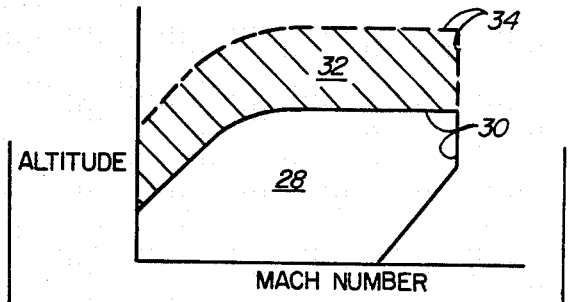
FIG. 2 is a graph illustrating the expanded flight envelope in which the engine may be operated due to the substantially improved ignition stability and relight capabilities of the combustor.

Conventional combustors used in aircraft jet propulsion engines are of fixed geometry construction and are designed to be operated only within a predetermined altitude-mach number flight envelope such as envelope 28 bounded by the solid line 30 in the graph of FIG. 2. If an attempt is made to operate the conventional combustor at higher altitudes or lower mach numbers than those within envelope 28 (i.e., within, for example, the crosshatched area 32 bounded by line 30 and dashed line 34 in FIG. 2), the ignition stability and altitude relight capabilities of the combustor are adversely affected. More specifically, if a conventional, fixed geometry combustor were to be operated within the representative flight envelope expansion area 32, the combustion process in the combustor would be subject to abrupt, unintended extinguishment, causing an equally abrupt engine power loss. Compounding this rather serious problem, substantial difficulty would normally be encountered in relighting the combustor until the aircraft dropped back into the normal flight envelope 28.

Not only is the upper boundary of a gas turbine propulsion engine's flight envelope limited by conventional fixed geometry combustor apparatus as just described, but certain other previously necessary combustor design compromises limit the engine's performance—even within the design flight envelope 28. One such limitation arising from the use of conventional fixed geometry combustors is the occurrence of engine ground starting difficulty—expecially at low ambient temperatures.

As will now be described with reference to FIGS. 3–5, the combustor 12 of the present invention is of a unique, variable geometry construction which permits the engine 10 to be efficiently and reliably operated within the substantially expanded flight envelope 28, 32 without these lean stability, altitude relight, or ground start problems of fixed geometry combustors.

Figure 3:
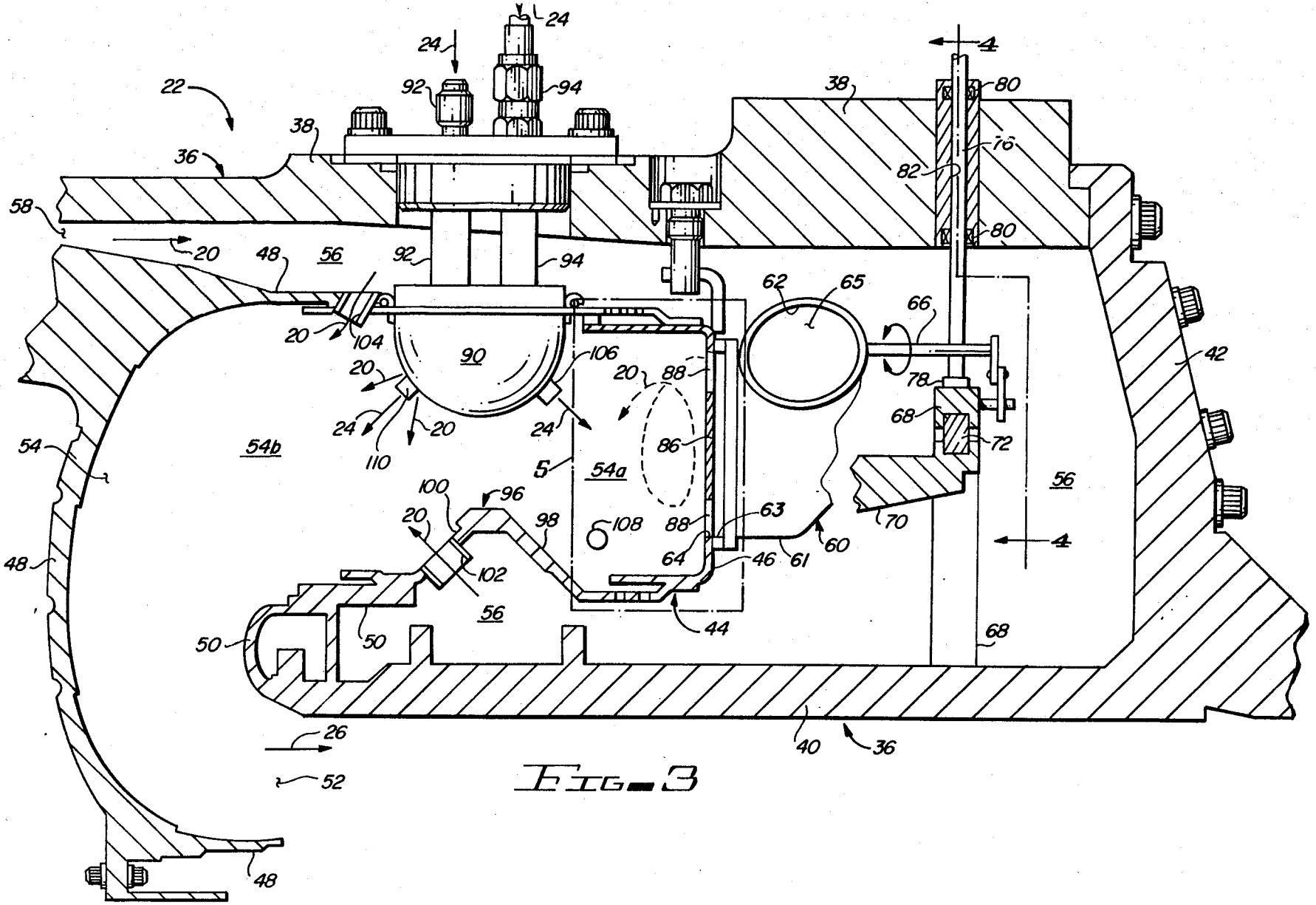
FIG. 3 is a greatly enlarged cross-sectional view through area 3 of the combustor of FIG. 1, with portions of the combustor interior details being broken away or omitted for illustrative clarity.

Referring to FIG. 3, the combustor 22 includes a hollow, annular outer housing 36 having an annular radially outer sidewall 38 and an annular, radially inner sidewall 40 spaced apart from and connected to sidewall 38 by an annular upstream end wall 42. Positioned coaxially within the housing 36 is an upstream end portion of an annular, hollow combustor liner 44 having a reverse flow configuration. Liner 44 has an annular upstream end wall 46 spaced axially inwardly from the housing end wall 42, and annular radially outer and inner sidewalls 48, 50 which extend leftwardly (as viewed in FIG. 3) from liner end wall 46 and then curve radially inwardly through a full 180°. At their downstream termination, the liner sidewalls 48, 50 define an annular discharge opening 52 through which the hot discharge gas 26 is expelled from the interior or combustion flow passage 54 of liner 44.

The interior of housing 36 defines an intake plenum 56 which circumscribes the upstream end portion of liner 44 as indicated in FIG. 3. Compressor discharge air 20 is forced into plenum 56 through an annular inlet opening 58 which circumscribes the liner 44 and is positioned at the left end of combustor 22. A portion of this pressurized air is used to cool the liner sidewalls 48, 50 during combustor operation. Although these sidewalls are, for the most part, shown in FIG. 3 as being of solid construction for the sake of clarity, they are actually of a conventional "skirted" construction. More specifically, as best illustrated in FIG. 5, the sidewalls 48, 50 have, along adjacent axial portions of their lengths, overlapping, radially spaced inner and outer wall segments 48*a*, 48*b* and 50*a*, 50 *b*. To cool the walls 48, 50 air 20 is forced inwardly through openings 49, 51 formed respectively through the wall segments 48*b*, 50*b*. The entering air impinges upon the inner wall segments 48*a*, 50*a*and enters the combustion flow passage 54, in a downstream direction, through exit slots 48*c*, 50*c* formed between the skirted wall segments.

Compressor discharge air 20 entering plenum 56 is selectively admitted to the liner combustion flow passage 54 through a circumferentially spaced series of spoon valves 60 (see also FIG. 4) positioned within the plenum 56 and connected externally to the liner end wall 46 around its circumference. Each of the valves 60 has a hollow body 61 with a circular inlet opening 62 which faces generally tangentially relative to the liner end wall periphery, and a circular outlet 63 which registers with one of a circumferentially spaced series of circular inlet openings 64 formed through the liner end wall 44 as best illustrated in FIG. 3.

Figure 4:
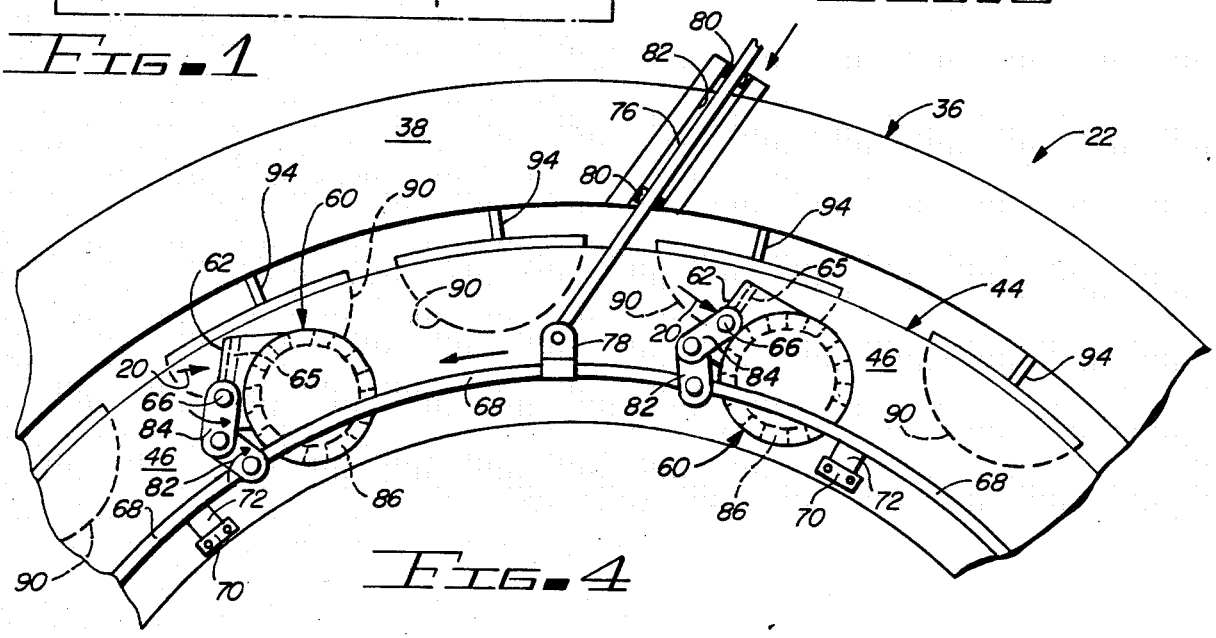
FIG. 4 is a reduced scale, fragmentary cross-sectional view of the combustor taken along line 4—4 of FIG. 3.
Figure 5:
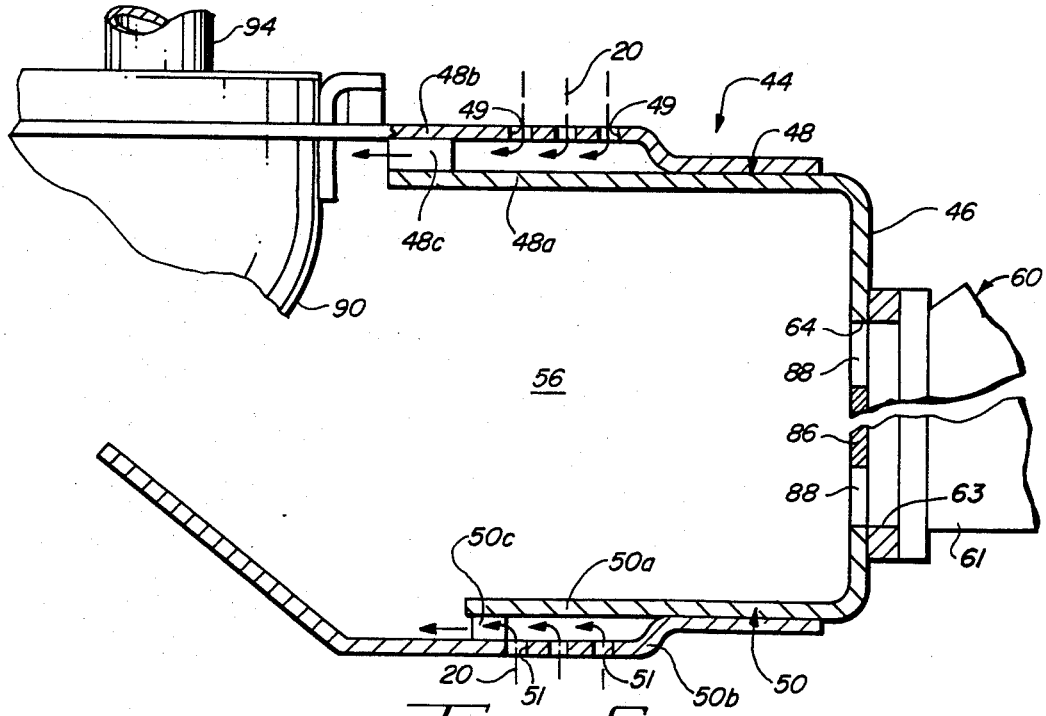
FIG. 5 is a fragmentary enlargement of the FIG. 3 cross-sectional area 5 of the combustor.

Within each of the valve bodies 61, adjacent its inlet opening 62, is a circular flapper element 65 (FIGS. 3 and 4 which may be pivotally opened and closed, to regulate the air flow through the valve, by means of an acuating rod 66 secured at one end to the periphery of the flapper element. From its connection to its respective valve element, each of the rods 66 extends lengthwise toward the housing end wall 42 within plenum 56 and is pivotable about its axis to move its valve's flapper element 65 between the open and closed positions.

Valves 60 may be simultaneously opened or closed by means of an actuation system which includes a unison ring 68 positioned coaxially within the plenum 56 between the valves 60 and the housing end wall 42. Unison ring 68 is rotatably supported within plenum 56 by a circumferentially spaced series of support brackets 70 positioned radially inwardly of the ring and secured to the liner end wall 46 as can best be seen in FIG. 4. Rotation of the unison ring is facilitated by carbon bearing blocks 72 carried by each of the brackets 70 and slidably received in a circumferential channel 74 (FIG. 3) formed in the radially inner surface of the ring.

To simultaneously open or close the valves 60, ring 68 is rotated by axial motion of a control rod 76 which is pivotally connected at its inner end to a connecting member 78 secured to the unison ring. Rod 76 is generally perpendicular to the axis of the unison ring and is angled relative to the ring's radius at connection point 78. From its inner end connection to member 78, rod 76 extends outwardly through the housing sidewall 38 through suitable bearing and seal members 80 positioned and retained within a circular bore 82 formed through such sidewall.

The selective axial motion of control rod 72 may be achieved by any desired conventional actuation means (not shown) positioned outside the combustor housing 36. Rotation of the ring 68 caused by such axial motion of control rod 76 is converted to simultaneous rotation of the valve actuation rods 66 by means of circumferentially spaced sets of linking members 82, 84 positioned adjacent the outer end of each of the actuation rods 66. As can best be seen in FIG. 4, at each of the valves 60 the inner end of a linking member 82 is pivotally connected to the unison ring 68, the outer end of the member 82 is pivotally connected to the inner end of a linking member 84, and the outer end of the member 84 is nonrotatably secured to the actuation rod 66 of the adjacent valve. Thus, as viewed in FIG. 4, when the control rod 76 is moved inwardly, the unison ring 68 is rotated in a counterclockwise direction, the linking members 82 are rotated in a clockwise direction, and the linking members 84 are rotated in a counterclockwise direction, thereby simultaneously rotating each of the valve actuation rods 66 in a counterclockwise direction. In a like manner, outward axial movement of the control rod 76 causes simultaneous clockwise rotation of the actuation rods 66.

When the valves 60 are moved to their open position, compressor discharge air 20 in the plenum 56 is forced into the combustion flow passage 54 through circular swirl plates 86 positioned in each of the liner end wall openings 64. Each of these swirl plates has, around its periphery, vaned swirl slots 88 which impart to the air 20 entering the liner interior an axially and tangentially directed swirl pattern as indicated in FIG. 3. The fuel 24 is introduced into the combustion flow passage 54 for mixture with the swirling air 20 by means of a circumferentially spaced series of stageable, fuel nozzles 90, to each of which is connected a pair of fuel supply lines 92, 94 extending inwardly through the outer combustor housing sidewall 38.

As illustrated in FIGS. 3 and 4, each of the nozzles 90 projects radially into the upstream portion of the combustor liner 44, through liner sidewall 48, downstream from the liner end wall 46. Directly across the flow passage 54 from the nozzles, and radially spaced therefrom, is an axial portion 96 of liner sidewall 50 which projects radially into the liner interior 54 around the entire circumference of sidewall 50. The inwardly projecting liner wall portion 96 has an annular, inclined wall section 98 which generally faces the liner and wall 46, and an oppositely facing annular, inclined wall section 100. Circumferentially spaced series of air inlet openings 102, 104 (only one opening of each series being shown in FIG. 3) are formed respectively through sidewall section 100 and liner sidewall 48 (immediately downstream of nozzles 90) around their circumferences. These inlet openings are sloped in a downstream direction and serve as dilution air openings for admitting pressurized combustion discharge air 20 into the combustion flow passage 54 from the plenum 56. Admission of such dilution air functions in a generally conventional manner to provide a substantially uniform hot dischage gas temperature profile at the combustor discharge opening 52.

As will now be described, the nozzles 90 and the inwardly projecting liner wall portion 96 uniquely cooperate to substantially improve the ignition stability of the combustor 22. Additionally, the variable geometry feature of the combustor (i.e., the simultaneously controlled inlet valves 60) substantially improve its ground start, high altitude relight, and lean stability capabilities. Together these two novel features of the combustor permit it to be operated safely and efficiently within the expanded flight envelope portion 32 illustrated in FIG. 2—an operating area well beyond the limitations of conventional fixed geometry combustor apparatus.

The nozzles 90 and projecting liner wall portion 96 cooperatively define within the combustion flow passage 54 a partial barrier which generally divides an upstream portion of the flow passage into a pilot combustion zone **54*a* between the nozzles and the liner end wall 46, and a main combustion zone 54*b* immediately downstream from the nozzles. These two axially spaced combustion zones are each of an annular configuration and communicate through the radial gaps between the nozzles and liner wall portion 96** and the circumferential gaps between the nozzles.

Upon initial startup of the turbine engine 10, the combustor valves 60 are brought to their fully closed position by the unison ring actuation system as previously described, and fuel 24 is sprayed into the pilot combustion zone **54*a*, via fuel lines 94, through pressure atomizing outlet heads 106 positioned on each of the nozzles 90. As indicated in FIG. 3, fuel 24 sprayed from each head 106 is directed generally toward the liner end wall 46, at a radially inwardly sloped angle. Combustion within the pilot zone 54*a* is inititated by conventional igniter means 108**.

The engine may then be brought to within its normal operating range by opening the valves 60, thereby forcing the swirling air 20 into the combustion flow passage, and spraying fuel 24 into the main combustion zone **54*b*, via fuel supply line 92, through air blast fuel nozzle heads 110 positioned on each of the nozzles 90 and directed into the main combustion zone at a radially inwardly sloped angle. The fuel spray heads 110 are of the air blast type and, in a conventional manner, mix compressor discharge air 20, from the plenum 56, with the sprayed fuel 24 as indicated in FIG. 3. With the introduction of the swirling air 20, and the fuel sprays from heads 106, 110, continuous combustion is maintained in each of the axially spaced combustion zones 54*a*, 54*b***.

During operation of the combustor, the nozzles 90 and the liner wall portion 96 cooperate to "shelter" the combustion process in the pilot zone against adverse interaction with the combustion process in the main combustion zone, and additionally shelter it from sudden back pressure within the flow passage 54.

As an example, if fuel flow to the heads 110 is abruptly terminated to sharply reduce the engine power level, the combustion in main zone **54*b* is equally abruptly terminated. In conventional fixed geometry combustors, such a rapid dimunition in total combustor fuel supply can tend to extinguish all combustion—especially when the combustor is operated outside the design flight envelope 28. However, in combustor 22 this undesirable result is substantially eliminated because a large portion of the combustion flow passage area through which the main combustion zone extinguishment effect could be transmitted to the pilot zone is physically blocked by the nozzles 90 and liner wall portion 96**. Such sheltering of the pilot zone by the nozzle and liner wall partial barrier also protects against extinguishment of combustion in the pilot zone in instances where the combustion flow passage experiences a sudden back pressure caused, for example, when the engine experiences a stall condition.

From the above, it can be seen that the novel structural arrangement of the nozzles and liner wall portions 90, 96 of combustor 22 substantially enhances its ignition stability. It is this aspect of the present invention which permits normal operation (i.e., full combustion within each of the zones 54*a*, 54*b*) of combustor 22 within the expanded flight envelope portion 32.

The variable geometry combustor intake valve system provides an additional measure of reliability and safety within the envelope zone 32 by greatly improving the high altitude relight capability of the combustor. In the event that the pilot zone combustion is extinguished during flight, the intake valves 60 are simply moved to their fully closed positions, thereby shutting off all combustor air supply through the swirlers 86. This instantly maximizes the fuel richness within the pilot zone 54*a*, permitting rapid relight of the combustor and a return of the engine to normal power output levels. Such richness maximization capability also improves the ground start capabilities of the engine under low ambient temperature conditions.

In summary, the present invention provides improved combustor apparatus and associated methods which permit a gas turbine propulsion engine to be safely and reliably operated well beyond the altitude and mach number limits heretofore imposed by fixed geometry combustors.

The foregoing detailed description is to be clearly understood as given by way of illustration and example only, the spirit and scope of this invention being limited solely by the appended claims.

What is claimed is:

1. High performance variable geometry combustor apparatus, said apparatus having an axis and comprising:

(a) wall means defining a combustion flow passage extending downstream from an upstream end wall portion of said wall means along and within a sidewall portion thereof, said sidewall portion having an inwardly projecting section positioned downstream from said end wall portion;

(b) nozzle means, projecting inwardly through said sidewall portion generally opposite from said inwardly projecting section thereof, for injecting fuel into said flow passage, said nozzle means being spaced apart from said inwardly projecting sidewall section and cooperating therewith to define in said flow passage;

(1) a pilot combustion zone adjacent said upstream end wall portion, (2) a main combustion zone positioned downstream from and communicating with said pilot zone, and (3) a barrier for sheltering combustion in said pilot combustion zone against back pressure in said flow passage or adverse interaction with combustion in said main combustion zone; and (c) means for flowing a selectively variable quantity of pressurized combustion air from a source thereof into said pilot combustion zone, said means (c) including a plurality of mutually spaced inlet openings extending through said end wall, a plurality of valve means each secured to said end wall over one of said openings therein, and means for simultaneously operating said valve means, said means for simultaneously operating said valve means comprising an actuating member rotatable relative to said wall means about said axis, and linking means interconnected between said actuating member and said valve means for simultaneously operating said valve means in response to rotation of said actuating member, said actuating member being a unison ring carried by said wall means for rotation about said axis, said valve means each having an actuating rod rotatable about an axis generally parallel to said apparatus axis, and said linking means being interconnected between said unison ring and said valve actuation rods to cause simultaneous rotation of said valve actuation rods in response to rotation of said unison ring.

2. High performance variable geometry combustor apparatus comprising:

(a) wall means defining a combustion flow passage extending downstream from an upstream end wall portion of said wall means along and within a sidewall portion thereof, said sidewall portion having an inwardly projecting section positioned downstream from said end wall portion;

(b) nozzle means, projecting inwardly through said sidewall portion generally opposite from said inwardly projecting section thereof, for injecting fuel into said flow passage, said nozzle means being spaced apart from said inwardly projecting sidewall section and cooperating therewith to define in said flow passage:

(1) a pilot combustion zone adjacent said upstream end wall portion, (2) a main combustion zone positioned downstream from and communicating with said pilot combustion zone, and (3) a barrier for sheltering combustion in said pilot combustion zone against back pressure in said flow passage or adverse interaction with combustion in said main combustion zone; and (c) means for flowing a selectively variable quantity of pressurized combustion air from a source thereof into said pilot combustion zone, said nozzle means (b) including means for selectively injecting fuel into either or both of said pilot and main combustion zones.

3. A variable geometry gas turbine engine combustor comprising:

(a) a liner having an upstream end wall, a sidewall portion extending from said end wall and defining therewith a combustion flow passage, said sidewall portion having an inwardly projecting section positioned downstream from said end wall;

(b) a housing receiving said end wall and said sidewall portion and defining therewith a plenum for receiving pressurized air from a source thereof;

(c) fuel nozzle means projecting into said flow passage through said sidewall portion at a location generally opposite said inwardly projecting section thereof, said fuel nozzle means being spaced apart from said inwardly projecting sidewall section and cooperating therewith to define in said flow passage a pilot combustion zone positioned between said sidewall section and said end wall, and a main combustion zone communicating with said pilot combustion zone and positioned downstream from said sidewall section, said fuel nozzle means being operable to selectively inject fuel into either or both of said pilot and main combustion zone; and (d) means for admitting a selectively variable quantity of pressurized air from said plenum into said pilot combustion zone, wherein said end wall is of an annular configuration and circumscribes an axis of said combustor, said sidewall portion includes annular, mutually spaced radially inner and outer sidewalls extending in a downstream direction from said end wall, and wherein said means (d) include a circumferentially spaced series of inlet openings extending through said end wall, a circumferentially spaced series of inlet valves each operatively connected to said end wall over one of said inlet openings, and means for simultaneously operating said inlet valves, said inlet valves having rotatable actuating rods, and said means for simultaneously operating said inlet valves including an actuating ring positioned in said plenum, means for supporting said ring from said liner for rotation about said axis, linking means interconnected between said ring and said rods for simultaneously rotating said rods in response to rotation of said ring, and means for selectively rotating said ring.

4. The combustor of claim 3 wherein said means for selectively rotating said actuating ring comprise a control member connected to said ring, extending outwardly through said housing, and movable relative to said housing along an axis generally perpendicular to said combustor axis to selectively rotate said actuating ring.

5. A variable geometry combustor for a gas turbine propulsion engine or the like, comprising:

(a) a hollow, annular combustor liner having an annular upstream end wall from which mutually spaced radially inner and outer sidewalls extend in a downstream direction, said liner end wall having a circumferentially spaced series of air inlet openings extending axially therethrough, said walls of said liner defining in said combustor a combustion flow passage, a portion of said radially inner sidewall projecting into said combustion flow passage and partially dividing the same into a pilot combustion zone portion adjacent said end wall, and a main combustion zone positioned downstream from said pilot combustion zone portion;

(b) a hollow, annular combustor housing coaxially enveloping an upstream end portion of said liner and defining therewith an intake plenum for receiving pressurized air from a source thereof, said housing having an end wall axially spaced in an upstream direction from said liner end wall;

(c) a circumferentially spaced series of valve means each secured to said liner end wall at one of said inlet openings therein and operable to flow a selectively variable quantity of pressurized air from said plenum into the liner interior through such opening; and (d) means for simultaneously operating each of said valve means, said means (d) comprising a series of actuating rods each rotatably connected to one of said valve means to operate the same, a unison ring, means for coaxially mounting said unison ring within said intake plenum for rotation relative to said liner, means for selectively rotating said unison ring, and means interconnected between said unison ring and said actuating rods for rotating said rods in response to rotation of said unison ring, (e) means for imparting a swirling flow pattern to air entering the liner interior through said inlet openings in said liner end wall; and (f) a circumferentially spaced series of nozzle means each projecting generally radially into the liner interior through said radially outer sidewall at a location spaced in a downstream direction from said liner end wall end radially opposite said projecting radially inner sidewall portion, said nozzle means each being operable to inject fuel into a selected one or both of said pilot and main combustion zones of said flow passage, and being spaced apart from said inwardly projecting portion of said radially inner sidewall.

* * * * *